US010045141B2

(12) United States Patent
Vilermo et al.

(10) Patent No.: US 10,045,141 B2
(45) Date of Patent: Aug. 7, 2018

(54) DETECTION OF A MICROPHONE

(71) Applicant: Nokia Technologies Oy, Espoo (FI)

(72) Inventors: Miikka Tapani Vilermo, Siuro (FI); Jorma Makinen, Tampere (FI); Anu Huttunen, Tampere (FI); Mikko Tapio Tammi, Tampere (FI)

(73) Assignee: WSOU Investments, LLC, Los Angeles, CA (US)

( * ) Notice: Subject to any disclaimer, the term of this patent is extended or adjusted under 35 U.S.C. 154(b) by 254 days.

(21) Appl. No.: 14/519,052

(22) Filed: Oct. 20, 2014

(65) Prior Publication Data

US 2015/0124980 A1 May 7, 2015

(30) Foreign Application Priority Data

Nov. 6, 2013 (GB) ..... 1319612.6

(51) Int. Cl.
*H04R 29/00* (2006.01)
*H04R 3/00* (2006.01)

(52) U.S. Cl.
CPC ..... *H04R 29/006* (2013.01); *H04R 3/005* (2013.01); *H04R 2499/11* (2013.01)

(58) Field of Classification Search
CPC ..... H04R 29/006; H04R 3/005; H04R 1/406; H04R 1/326; H04R 2499/11
USPC ..... 381/92, 122, 334, 58
See application file for complete search history.

(56) References Cited

U.S. PATENT DOCUMENTS 8,204,253 B1 6/2012 Solbach
2003/0198354 A1 10/2003 Stuart
2005/0018861 A1 1/2005 Tashev
2005/0195988 A1 9/2005 Tashev et al.
2007/0076900 A1 4/2007 Kellermann et al.
2009/0164212 A1 6/2009 Chan et al.
2009/0196429 A1 8/2009 Ramakrishnan et al.
2010/0158267 A1* 6/2010 Thormundsson ..... H04R 3/005 381/92
2011/0033063 A1 2/2011 McGrath et al.
2011/0103617 A1 5/2011 Shin
2011/0313763 A1 12/2011 Amada
(Continued)

FOREIGN PATENT DOCUMENTS

WO 2014/037766 A1 3/2014

OTHER PUBLICATIONS

International Search Report and Written Opinion received for corresponding Patent Cooperation Treaty Application No. PCT/FI2014/050802, dated Jan. 27, 2015, 13 pages.
(Continued)

*Primary Examiner* — Xu Mei
*Assistant Examiner* — Douglas Suthers
(74) *Attorney, Agent, or Firm* — Sean D. Burdick

(57) ABSTRACT

An apparatus comprising: an input configured to receive at least two microphone signals associated with at least one acoustic source; an audio source determiner configured to determine from at least part of the at least two microphone signals at least one audio source based on the at least one acoustic source; an audio source direction determiner configured to determine at least one direction associated with the determined at least one audio source; a calibrator configured to calibrate at least one of the at least two microphone signals based on the at least one direction.

20 Claims, 8 Drawing Sheets

(56) References Cited

U.S. PATENT DOCUMENTS

| | | | | |
|---|---|---|---|---|
| 2011/0317848 | A1 | 12/2011 | Ivanov et al. | |
| 2012/0128174 | A1* | 5/2012 | Tammi | H04S 1/002 381/92 |
| 2012/0269356 | A1 | 10/2012 | Sheerin et al. | |
| 2013/0132845 | A1 | 5/2013 | Tammi et al. | |

OTHER PUBLICATIONS

Buck et al., "Microphone Calibration for Multi-Channel Signal Processing", Speech and Audio Processing in Adverse Environments Signals and Communication Technology, 2008, pp. 417-467.
Wiggins, "An Investigation Into the Real-Time Manipulation and Control of Three-dimensional Sound Fields", PhD thesis, 2004, 370 pages.
Hua et al., "A New Self-Calibration Technique for Adaptive Microphone Arrays", International Workshop on Acoustic Signal Enhancement, 2005, pp. 237-240.
Search Report received for corresponding United Kingdom Patent Application No. 1319612.6, dated Dec. 16, 2013, 3 pages.
Extended Search Report for European Application No. EP 14 85 9915 dated Mar. 10, 2017.

* cited by examiner

DETECTION OF A MICROPHONE

FIELD

The present application relates to apparatus and methods for the detection of impaired microphones and specifically but not only microphones implemented within mobile apparatus.

BACKGROUND

Audio recording systems can make use of more than one microphone to pick-up and record audio in the surrounding environment. Mobile devices increasingly have several microphones. The microphones are used for many applications like surround sound (such as 5.1 channel) capture and noise cancellation. Many signal processing algorithms for multiple microphones require the microphones to be well calibrated in relation to each other. Also, many algorithms need as close to as possible free-field conditions to work well. However, the mobile device itself shadows sounds coming from certain directions to a microphone. The shadowing effect is different for microphones placed to different parts of the device. However, there usually are some directions from which the shadowing effect is the same for 2 or more microphones.

Furthermore occasionally the operation of one or more of these microphones may become impaired. For example, a microphone may become blocked, partially blocked, broken or otherwise impaired in operation.

For example, small particles such as dust may become embedded in the microphone leading to a deterioration in the operation of the microphone, a microphone may become blocked or partially blocked by a finger or other body part, a microphone may break or partially break due to a mechanical or other cause and/or a microphone may become impaired due to sound distortion introduced by environmental factors such as wind.

This may lead to a reduction in the quality of the recorded audio.

SUMMARY

According to a first aspect there is provided a method comprising: receiving at least two microphone signals associated with at least one acoustic source; determining from at least part of the at least two microphone signals at least one audio source based on the at least one acoustic source; determining at least one direction associated with the determined at least one audio source; calibrating at least one of the at least two microphone signals based on the at least one direction.

Determining from at least part of the at least two microphone signals at least one audio source based on the at least one acoustic source may comprise filtering each of the at least two microphone signals to generate a respective at least two associated microphone signal parts.

Determining at least one direction associated with the determined at least one audio source may comprise: determining a maximum correlation time difference between a pair of the at least part of the two microphone signals; determining a direction based on the maximum correlation time difference.

Calibrating at least one of the at least two microphone signals based on the at least one direction may comprise determining the direction based on the maximum correlation time difference is substantially at least one determined calibration direction.

Determining the direction based on the maximum correlation time difference is substantially the at least one determined calibration direction may comprise determining the direction based on the maximum correlation time difference is within at least one determined calibration direction sector.

The method may further comprise defining at least one direction for which the at least part of the at least two microphone signals have an expected signal relationship, wherein the expected signal relationship may be at least one of: signal level relationship; signal phase relationship.

The expected signal level relationship may be at least one of: equal signal levels of the at least part of the at least two microphone signals; a predefined ratio between the at least part of the at least two microphone signals.

Calibrating at least one of the at least two microphone signals based on the at least one direction may comprise calibrating the at least two microphone signals based on the signal levels of the at least part of the at least two microphone signals and the expected signal level relationship.

Calibrating at least one of the at least two microphone signals based on the at least one direction may comprise calibrating the at least two microphone signals based on the number of times the operation of calibrating the at least two microphone signals had been performed.

Calibrating at least one of the at least two microphone signals based on the at least one direction may comprise determining or updating at least one calibration value associated with a respective microphone signal based on at least one of: a number of times the operation of calibrating the at least one of at least two microphone signals had been performed; a signal level associated with the at least part of the at least two microphone signals; an expected signal level relationship between the at least part of the at least two microphone signals when the at least one audio source is associated with at least one determined direction; a signal phase difference associated with the at least part of the at least two microphone signals; an expected signal phase difference relationship between the at least part of the at least two microphone signals when the at least one audio source is associated with at least one determined direction.

According to a second aspect there is provided an apparatus comprising: means for receiving at least two microphone signals associated with at least one acoustic source; means for determining from at least part of the at least two microphone signals at least one audio source based on the at least one acoustic source; means for determining at least one direction associated with the determined at least one audio source; means for calibrating at least one of the at least two microphone signals based on the at least one direction.

The means for determining from at least part of the at least two microphone signals at least one audio source based on the at least one acoustic source may comprise means for filtering each of the at least two microphone signals to generate a respective at least two associated microphone signal parts.

The means for determining at least one direction associated with the determined at least one audio source may comprise: means for determining a maximum correlation time difference between a pair of the at least part of the two microphone signals; means for determining a direction based on the maximum correlation time difference.

The means for calibrating at least one of the at least two microphone signals based on the at least one direction may comprise means for determining the direction based on the maximum correlation time difference is substantially at least one determined calibration direction.

The means for determining the direction based on the maximum correlation time difference is substantially the at least one determined calibration direction may comprise means for determining the direction based on the maximum correlation time difference is within at least one determined calibration direction sector.

The apparatus may further comprise means for defining at least one direction for which the at least part of the at least two microphone signals have an expected signal relationship, wherein the expected signal relationship is at least one of: signal level relationship; signal phase relationship.

The expected signal level relationship may be at least one of: equal signal levels of the at least part of the at least two microphone signals; a predefined ratio between the at least part of the at least two microphone signals.

The means for calibrating at least one of the at least two microphone signals based on the at least one direction comprises means for calibrating the at least two microphone signals based on the signal levels of the at least part of the at least two microphone signals and the expected signal level relationship.

The means for calibrating at least one of the at least two microphone signals based on the at least one direction may comprise means for calibrating the at least two microphone signals based on the number of times the operation of calibrating the at least two microphone signals had been performed.

The means for calibrating at least one of the at least two microphone signals based on the at least one direction may comprise means for determining or updating at least one calibration value associated with a respective microphone signal based on at least one of: a number of times the operation of calibrating the at least one of at least two microphone signals had been performed; a signal level associated with the at least part of the at least two microphone signals; an expected signal level relationship between the at least part of the at least two microphone signals when the at least one audio source is associated with at least one determined direction; a signal phase difference associated with the at least part of the at least two microphone signals; an expected signal phase difference relationship between the at least part of the at least two microphone signals when the at least one audio source is associated with at least one determined direction.

According to a third aspect there is provided an apparatus comprising at least one processor and at least one memory including computer code for one or more programs, the at least one memory and the computer code configured to with the at least one processor cause the apparatus to: receive at least two microphone signals associated with at least one acoustic source; determine from at least part of the at least two microphone signals at least one audio source based on the at least one acoustic source; determine at least one direction associated with the determined at least one audio source; calibrate at least one of the at least two microphone signals based on the at least one direction.

Determining from at least part of the at least two microphone signals at least one audio source based on the at least one acoustic source may cause the apparatus to filter each of the at least two microphone signals to generate a respective at least two associated microphone signal parts.

Determining at least one direction associated with the determined at least one audio source may cause the apparatus to: determine a maximum correlation time difference between a pair of the at least part of the two microphone signals; determine a direction based on the maximum correlation time difference.

Calibrating at least one of the at least two microphone signals based on the at least one direction may cause the apparatus to determine the direction based on the maximum correlation time difference is substantially at least one determined calibration direction.

Determining the direction based on the maximum correlation time difference is substantially the at least one determined calibration direction may cause the apparatus to determine the direction based on the maximum correlation time difference is within at least one determined calibration direction sector.

The apparatus may further be caused to define at least one direction for which the at least part of the at least two microphone signals have an expected signal relationship, wherein the expected signal relationship may be at least one of: signal level relationship; signal phase relationship.

The expected signal level relationship may be at least one of: equal signal levels of the at least part of the at least two microphone signals; a predefined ratio between the at least part of the at least two microphone signals.

Calibrating at least one of the at least two microphone signals based on the at least one direction may cause the apparatus to calibrate the at least two microphone signals based on the signal levels of the at least part of the at least two microphone signals and the expected signal level relationship.

Calibrating at least one of the at least two microphone signals based on the at least one direction may cause the apparatus to calibrate the at least two microphone signals based on the number of times the operation of calibrating the at least two microphone signals had been performed.

Calibrating at least one of the at least two microphone signals based on the at least one direction may cause the apparatus to determine or update at least one calibration value associated with a respective microphone signal based on at least one of: a number of times the operation of calibrating the at least one of at least two microphone signals had been performed; a signal level associated with the at least part of the at least two microphone signals; an expected signal level relationship between the at least part of the at least two microphone signals when the at least one audio source is associated with at least one determined direction; a signal phase difference associated with the at least part of the at least two microphone signals; an expected signal phase difference relationship between the at least part of the at least two microphone signals when the at least one audio source is associated with at least one determined direction.

According to a fourth aspect there is provided an apparatus comprising: an input configured to receive at least two microphone signals associated with at least one acoustic source; an audio source determiner configured to determine from at least part of the at least two microphone signals at least one audio source based on the at least one acoustic source; an audio source direction determiner configured to determine at least one direction associated with the determined at least one audio source; a calibrator configured to calibrate at least one of the at least two microphone signals based on the at least one direction.

The audio source determiner may comprise at least one filter configured to filter each of the at least two microphone signals to generate a respective at least two associated microphone signal parts.

The audio source audio source direction determiner may comprise: a correlator configured to determine a maximum correlation time difference between a pair of the at least part of the two microphone signals; a direction determiner configured to determine a direction based on the maximum correlation time difference.

The calibrator may comprise a comparator configured to determine the direction based on the maximum correlation time difference is substantially at least one determined calibration direction.

The comparator be configured to determine the direction based on the maximum correlation time difference is within at least one determined calibration direction sector.

The apparatus may further comprise a memory configured to define at least one direction for which the at least part of the at least two microphone signals have an expected signal relationship, wherein the expected signal relationship may be at least one of: signal level relationship; signal phase relationship.

The expected signal level relationship may be at least one of: equal signal levels of the at least part of the at least two microphone signals; a predefined ratio between the at least part of the at least two microphone signals.

The calibrator may be configured to calibrate the at least two microphone signals based on the signal levels of the at least part of the at least two microphone signals and the expected signal level relationship.

The calibrator may be configured to calibrate the at least two microphone signals based on the number of times the operation of calibrating the at least two microphone signals had been performed.

The calibrator may be configured to determine or update at least one calibration value associated with a respective microphone signal based on at least one of: a number of times the operation of calibrating the at least one of at least two microphone signals had been performed; a signal level associated with the at least part of the at least two microphone signals; an expected signal level relationship between the at least part of the at least two microphone signals when the at least one audio source is associated with at least one determined direction; a signal phase difference associated with the at least part of the at least two microphone signals; an expected signal phase difference relationship between the at least part of the at least two microphone signals when the at least one audio source is associated with at least one determined direction.

Embodiments of the present application aim to address problems associated with the state of the art.

SUMMARY OF THE FIGURES

For better understanding of the present application, reference will now be made by way of example to the accompanying drawings in which.

EMBODIMENTS

The following describes in further detail suitable apparatus and possible mechanisms for the provision of the calibration of microphones and detection of an impaired operation of a microphone.

As described herein calibration of microphones (in relation with each other) within multi-microphone systems is required so that the multiple microphones applications described herein (such as implementing noise cancellation, audio source estimation and spatial capture and processing) can be implemented successfully. In such circumstances signal processing algorithms for multiple microphones do not work well unless the microphones are well calibrated in relation to each other and not blocked by fingers of the user.

Although calibration of the microphones can be made to a manufacturer's specifications it would be understood that a microphone operating in real world situations may be damaged, become partially blocked or otherwise impaired. In other words calibrating microphones individually would cost too much and the required calibration changes over time because of dust, component wear or other impairment. Furthermore users handle mobile devices very differently, therefore placing the microphones so that they would never be blocked is practically impossible.

Some signal processing algorithms (for example beamforming, multi-microphone noise cancellation) requires the microphones to have no more than 1 dB level difference in order to work properly. However as can be seen from FIG. 4, different microphones in a device can easily have a 6 dB (2× energy) difference between their signals when the sound is coming from some directions and the difference can reverse for other directions. Therefore a calibration algorithm that does not take the sound direction into account would not be accurate enough for all signal processing algorithms.

Embodiments may be implemented in an audio system comprising two or more microphones. Embodiments can be configured such that when a device has several microphones at least one of the microphones can be calibrated by estimating the direction of surrounding sounds using correlation between the microphone signals and using the direction to estimate the relative levels the microphone signals should have if correctly calibrated and comparing that level to the actual measured levels. The embodiments described herein can be configured to operate without requiring any user input and can improve microphone calibration over time also when the microphone calibration changes (because of practical use issues such as dirt in the microphone port).

Figure 1:
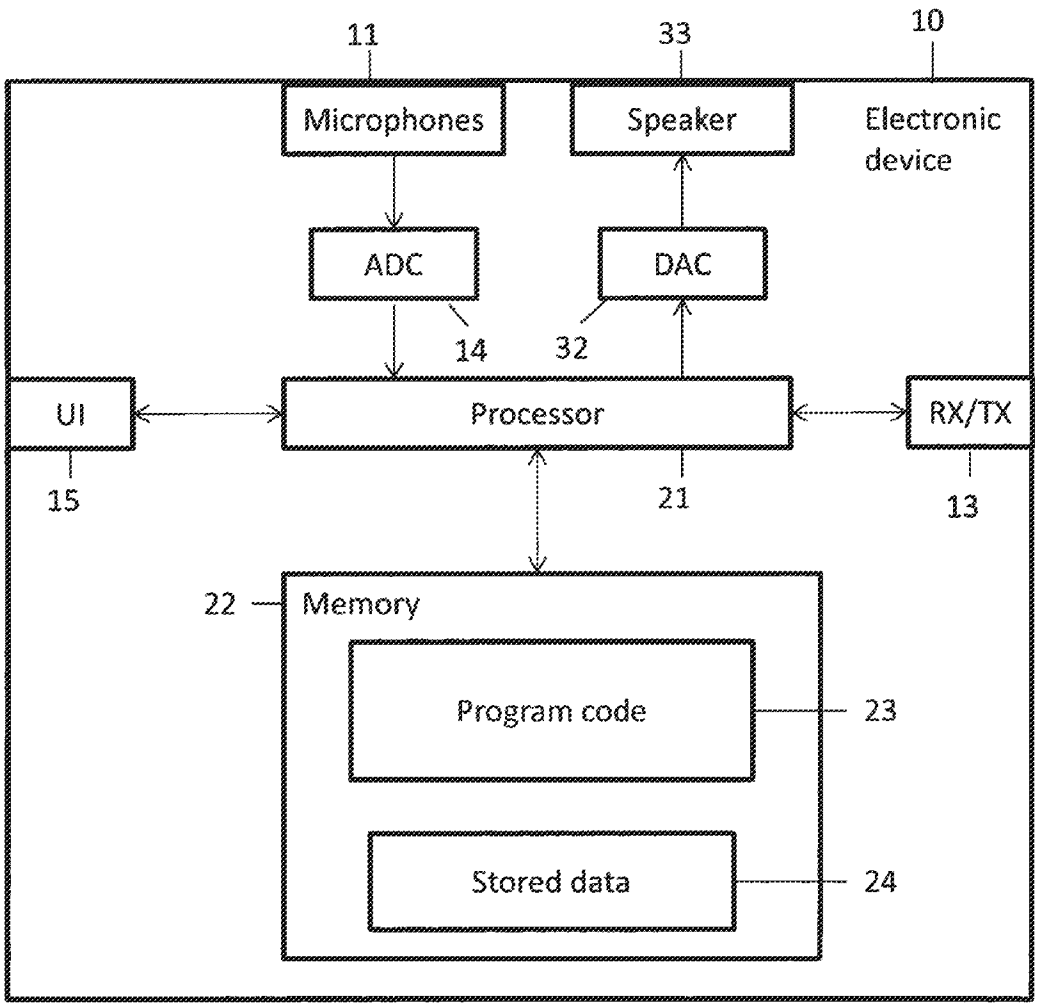
FIG. 1 shows schematically an apparatus suitable for being employed in some embodiments.

FIG. 1 shows an overview of a suitable system within which embodiments of the application can be implemented. FIG. 1 shows an example of an apparatus or electronic device 10. The electronic device 10 may be used to record or listen to audio signals and may function as a recording apparatus.

The electronic device 10 may for example be a mobile terminal or user equipment of a wireless communication system when functioning as the recording apparatus. In some embodiments the apparatus can be an audio recorder, a media recorder/player (also known as an MP4 player), or any suitable portable apparatus suitable for recording audio or audio/video camcorder/memory audio or video recorder.

The apparatus 10 may in some embodiments comprise an audio subsystem. The audio subsystem for example can comprise in some embodiments at least two microphones or array of microphones 11 for audio signal capture. In some embodiments the at least two microphones or array of microphones can be a solid state microphone, or a digital microphone capable of capturing audio signals and outputting a suitable digital format signal. In some other embodiments the at least two microphones or array of microphones 11 can comprise any suitable microphone or audio capture means, for example a condenser microphone, capacitor microphone, electrostatic microphone, Electret condenser microphone, dynamic microphone, ribbon microphone, carbon microphone, piezoelectric microphone, or micro electrical-mechanical system (MEMS) microphone. In some embodiments the microphone 11 is a digital microphone array, in other words configured to generate a digital signal output (and thus not requiring an analogue-to-digital converter). The microphone 11 or array of microphones can in some embodiments output the audio captured signal to an analogue-to-digital converter (ADC) 14.

In some embodiments the apparatus can further comprise an analogue-to-digital converter (ADC) 14 configured to receive the analogue captured audio signal from the microphones and outputting the audio captured signal in a suitable digital form. The analogue-to-digital converter 14 can be any suitable analogue-to-digital conversion or processing means. In some embodiments the microphones are 'integrated' microphones containing both audio signal generating and analogue-to-digital conversion capability.

In some embodiments the apparatus 10 audio subsystems further comprises a digital-to-analogue converter 32 for converting digital audio signals from a processor 21 to a suitable analogue format. The digital-to-analogue converter (DAC) or signal processing means 32 can in some embodiments be any suitable DAC technology.

Furthermore the audio subsystem can comprise in some embodiments a speaker 33. The speaker 33 can in some embodiments receive the output from the digital-to-analogue converter 32 and present the analogue audio signal to the user. In some embodiments the speaker 33 can be representative of multi-speaker arrangement, a headset, for example a set of headphones, or cordless headphones.

Although the apparatus 10 is shown having both audio capture and audio presentation components, it would be understood that in some embodiments the apparatus 10 can comprise only the audio capture part of the audio subsystem such that in some embodiments of the apparatus the microphones (for audio capture) are present.

In some embodiments the apparatus 10 comprises a processor 21. The processor 21 is coupled to the audio subsystem and specifically in some examples the analogue-to-digital converter 14 for receiving digital signals representing audio signals from the microphone 11, and the digital-to-analogue converter (DAC) 12 configured to output processed digital audio signals. The processor 21 can be configured to execute various program codes. The implemented program codes can comprise for example audio recording and microphone defect detection routines.

In some embodiments the apparatus further comprises a memory 22. In some embodiments the processor is coupled to memory 22. The memory can be any suitable storage means. In some embodiments the memory 22 comprises a program code section 23 for storing program codes implementable upon the processor 21. Furthermore in some embodiments the memory 22 can further comprise a stored data section 24 for storing data, for example data that has been recorded or analysed in accordance with the application. The implemented program code stored within the program code section 23, and the data stored within the stored data section 24 can be retrieved by the processor 21 whenever needed via the memory-processor coupling.

In some further embodiments the apparatus 10 can comprise a user interface 15. The user interface 15 can be coupled in some embodiments to the processor 21. In some embodiments the processor can control the operation of the user interface and receive inputs from the user interface 15. In some embodiments the user interface 15 can enable a user to input commands to the electronic device or apparatus 10, for example via a keypad, and/or to obtain information from the apparatus 10, for example via a display which is part of the user interface 15. The user interface 15 can in some embodiments comprise a touch screen or touch interface capable of both enabling information to be entered to the apparatus 10 and further displaying information to the user of the apparatus 10.

In some embodiments the apparatus further comprises a transceiver 13, the transceiver in such embodiments can be coupled to the processor and configured to enable a communication with other apparatus or electronic devices, for example via a wireless communications network. The transceiver 13 or any suitable transceiver or transmitter and/or receiver means can in some embodiments be configured to communicate with other electronic devices or apparatus via a wireless or wired coupling.

The coupling can be any suitable known communications protocol, for example in some embodiments the transceiver 13 or transceiver means can use a suitable universal mobile telecommunications system (UMTS) protocol, a wireless local area network (WLAN) protocol such as for example IEEE 802.X, a suitable short-range radio frequency communication protocol such as Bluetooth, or infrared data communication pathway (IRDA).

It is to be understood again that the structure of the electronic device 10 could be supplemented and varied in many ways.

Figure 4:
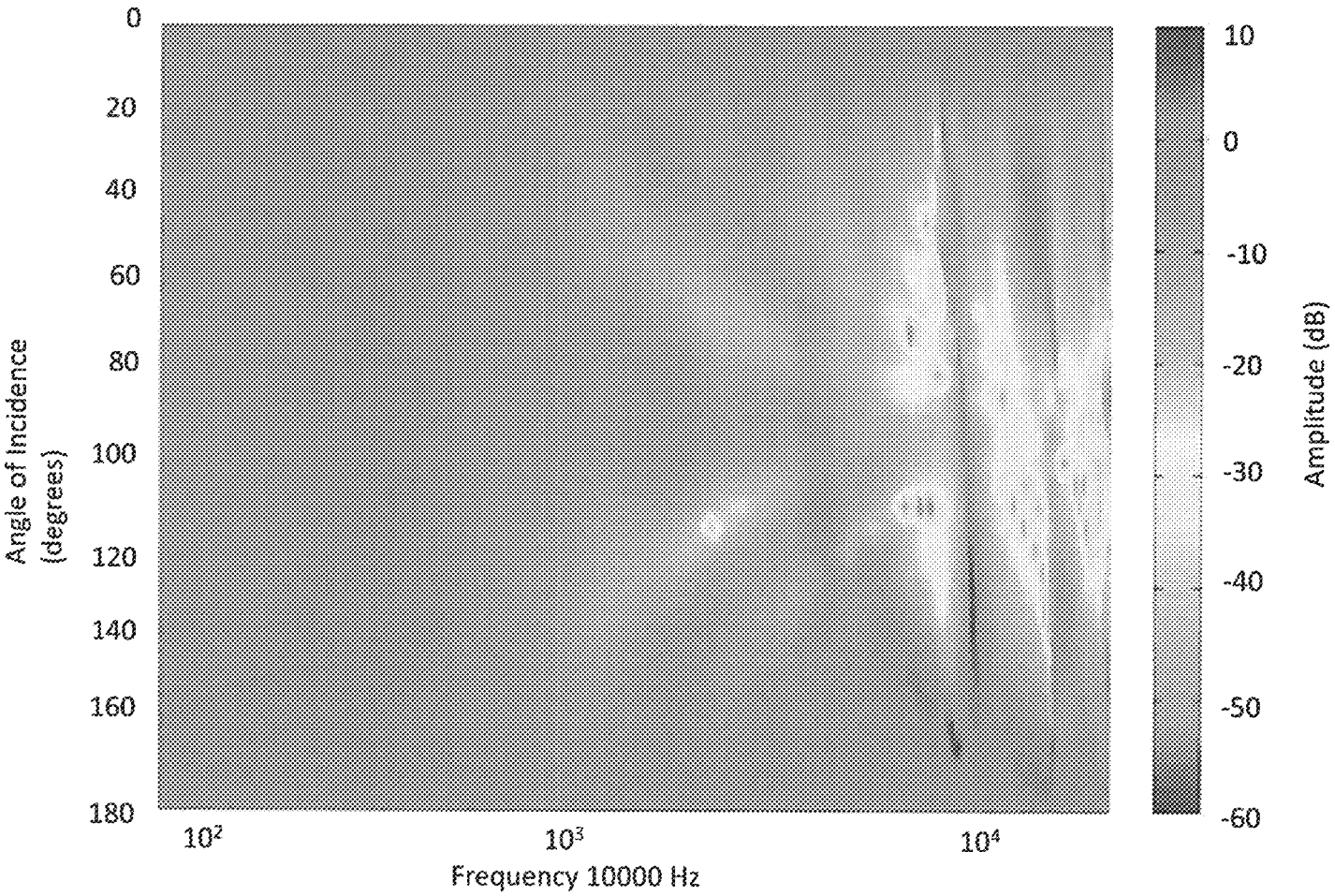
FIG. 4 shows schematically an example microphone system response graph.

The concept as described herein exploits the situation that different microphones placed on a mobile device can receive the same sound from a certain direction differently. This is because some of the frequency regions are attenuated by the shadowing effect of the mobile device or apparatus. For example the level difference of two microphones placed in a user's ears receiving sound from different directions is shown in FIG. 4. In this example the shadowing effect is caused by the head of the user rather than the apparatus or device on which the microphones are mounted but it would be understood that the effect is similar. As shown in FIG. 4 sounds coming or arising from some directions such as 0° and 180° arrive at the two microphones equally loud at all frequencies. However sounds coming from other directions can arrive at the microphones equally loud only at certain frequencies (such as shown as approximately 10 kHz around directions 0°, 40°, 100°, and 180° in FIG. 4).

Where two or more microphones on an apparatus or device are calibrated correctly there usually would be a direction and a frequency where if a sound arrives from that direction and at that frequency the sound arrives equally loud to all of the microphones. In such situations where the microphones are not calibrated correctly the lack of calibration shows as a level difference which can be used to recalibrate the audio signals. It would be understood that these directions and frequencies can be found for each apparatus (or device) and the microphone configuration by testing the device with sounds coming from different directions at different frequencies.

For example in some embodiments the apparatus comprising the calibrator can comprise N microphones $M_1, M_2, \ldots, M_N$. In the following embodiments the calibration system and the microphone apparatus are the same device. However it would be understood that in some embodiments the calibrator or calibration system is separate from the N microphones and can be configured to receive the audio signals from the microphones by a coupling, the coupling being any suitable data communication channel such as a wired coupling or a wireless coupling. For example in some embodiments the microphone system is a wearable microphone system, such as microphones configured to be positioned within or near a user's ears or on a user's body so to provide a user's point of reference.

During testing different subsets of 'properly' calibrated microphones on the device or apparatus react with the same level to sounds from certain directions at certain frequencies. This sub-set determination can be one which is determined during manufacture by a suitable specification measurement or acoustic modelling.

The information about the sub-sets can in some embodiments be saved. For example these sub-sets of microphones and the directions and frequencies can be stored in the list format shown herein:

$$\text{Subset 1: } [m_{X_{1,1}}, m_{X_{1,2}}, \ldots, m_{X_{1,N_1}}],\ {}_1,\ f_1$$

$$\text{Subset 2: } [m_{X_{2,1}}, m_{X_{2,2}}, \ldots, m_{X_{2,N_2}}],\ {}_2,\ f_2$$

$$\ldots$$

$$\text{Subset } M\text{: } [m_{X_{M,1}}, m_{X_{M,2}}, \ldots, m_{X_{M1,N_M}}],\ {}_M,\ f_M$$

where $$m_{X_{2,2}} \text{ to } m_{X_{1,N_1}}$$

defines the microphones within the first subset ($x_2$ the second subset and so on), $_1$ is the direction from which the audio signal is received for the first subset ($_2$ the direction from which the audio signal is received for the second subset and so on) and $f_1$ the frequency of the audio signal for the first subset ($f_2$ the frequency of the audio signal for the second subset and so on).

The audio signal, being directional is likely to arrive at the microphones at different times. The time differences between the microphones can be determined using trigonometry or be measured. Calibration by measurement as described herein by embodiments can be performed by determining or capturing or recording an audio signal with frequency f and direction a. The captured audio signal comprising an impulse from a direction can be band-pass filtered with a centre frequency (f). The time differences between the peaks in the filtered microphone signals can be determined as arrival time differences. Where the time difference between microphones $m_{Xi,k}$ and $m_{Xi,l}$ in Subset i is $\Delta(X_i, k, l)$ where $\Delta(X_i, k, l)$ is the time difference which would be expected when the direction of arrival of the audio signal is then the captured audio signal can be used to determine the current calibration between the microphones $m_{Xi,k}$ and $m_{Xi,l}$.

Figure 2:
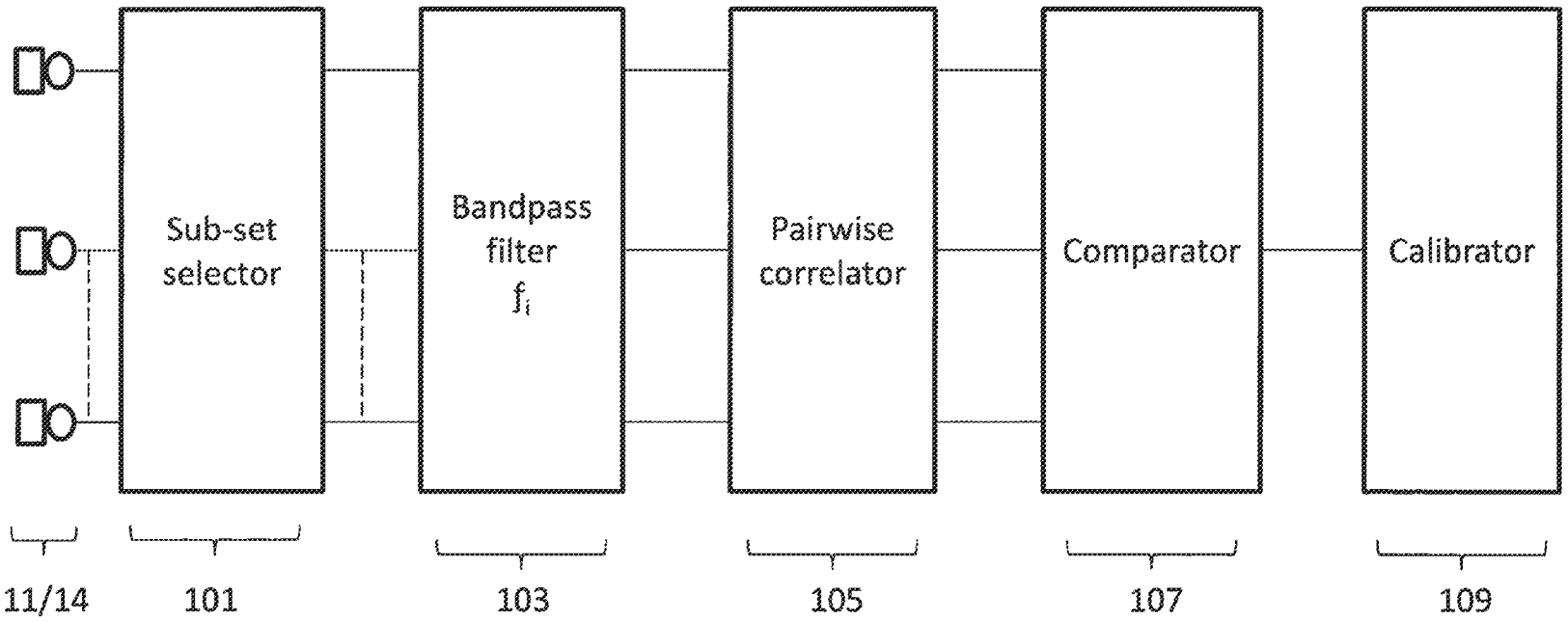
FIG. 2 shows schematically an example of a calibration system according to some embodiments.

With respect to FIG. 2 an example calibration system is shown according to some embodiments. Furthermore with respect to FIG. 3 the operation of the calibration system shown in FIG. 2 is shown in further detail.

In some embodiments the system comprises a plurality of microphones/digital converters 11/14 configured to generate multiple audio signals. In the following examples the microphones/digital converters are examples of integrated microphones configured to generate digital audio signals however it would be understood that in some embodiments the microphones are conventional microphones and the audio signals are converted and passed to the sub-set selector 101. Furthermore in some embodiments the microphones/digital converters are inputs configured to receive the microphone or converted microphone audio signals from a separate device. It would be understood that the audio signals from the microphones can be associated with at least one acoustic source, in other words the environment surrounding the microphones can be modelled or assumed to comprise a number of acoustic sources with associated directions which generate acoustic waves which are received by the microphones and which the microphones convert into audio signals.

In some embodiments the microphones/inputs output the audio signals to a subset selector 101.

Figure 3:
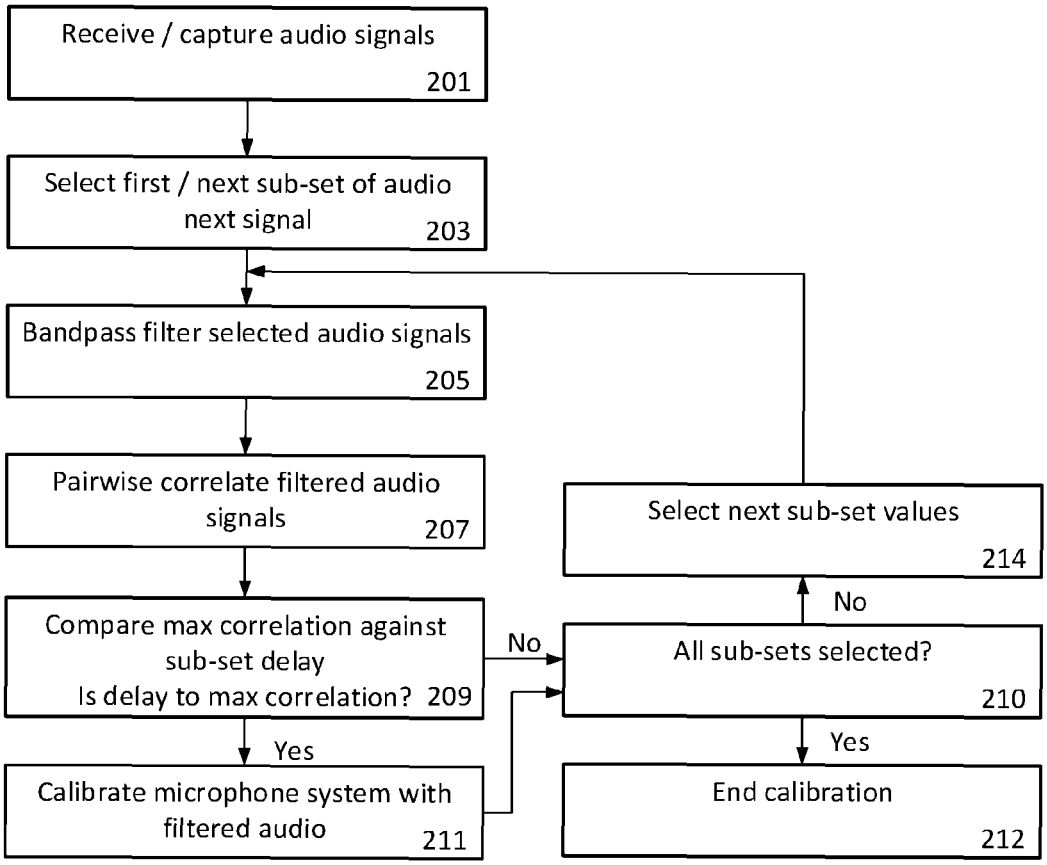
FIG. 3 shows schematically a flow diagram of the operation of a calibration system as shown in FIG. 2 according to some embodiments.

The operation of receiving/capturing audio signals is shown in FIG. 3 by step 201.

In some embodiments the calibration system comprises a subset selector 101. The subset selector 101 can in some embodiments be configured to receive the audio signals from each of the microphones/inputs and be further configured to select and output a determined sub-set of the inputs to a bandpass filter 103. In some embodiments the subset selector comprises determined subset information, in other words known or determined selections of inputs where it is known that properly calibrated microphones react with the same level to sounds from certain directions (at certain frequencies).

In some embodiments the subset selector 101 receives the information of the determined sub-set of inputs/microphones to select and output via an input. In such embodiments the system can receive such inputs from a controller configured to control the subset selector 101, the bandpass filter 103, and comparator 107 such that the sub-set (input) selection, frequency and direction are configured for the determined sub-sets. Furthermore in some embodiments the controller can be configured to receive the output of the calibrator 109 and store the calibration information associated with the sub-set calibration operation.

The subset selector 101 can be configured to output the audio signals from the determined subset. In the following embodiments the outputs are determined (and then processed) on a sequential sub-set basis. However it would be understood that in some embodiments the sub-set selector 101 can be configured to output parallel selections outputs, where at least two sub-sets of the inputs are analysed and processed at the same time to determine whether the input audio signals comprise a suitable calibration candidate.

The operation of selecting a first/next (or subsequent) sub-set of audio signals is shown in FIG. 3 by step 203.

In some embodiments the calibration system comprises a bandpass filter 103 or suitable means for filtering. The bandpass filter 103 is configured to receive the selected subset audio signals from the subset selector 101 and band-pass filter the audio signals at a centre frequency defined by the subset frequency $f_i$ (where i is the subset index). The bandpass filter 103 can then output the filtered selected audio signals to a pairwise correlator 105. The bandpass filter can be considered to be determining at least part of the at least two microphone signals from the at least two microphone signals.

In some embodiments the band-pass filter 103 comprises the determined subset centre-frequency information, in other words known or determined centre frequencies for the selection of audio signals where it is known that properly calibrated microphones react with the same level to sounds from certain directions. However as described above in some embodiments the band-pass filter 103 receives the centre frequency information via an input (and from a controller configured to control the bandpass filter 103 such that the sub-set selection, frequency and direction are configured for the determined sub-sets).

The operation of band pass filtering the selected audio signals at the sub-band centre frequency is shown in FIG. 3 by step 205.

Although the embodiments shown herein implement firstly the input selection followed by a bandpass filtering operation, it would be understood that in some embodiments the operations could be reversed. For example the audio signals are bandpass filtered and then selected or routed to be further processed.

Thus for example in some embodiments all of the audio signals are bandpass filtered into the subset filter ranges (or generally into filter ranges) and then the filtered microphone audio signals selected and passed to the pairwise correlator. In some embodiments this could be implemented by a filter bank and multiplexer arrangement configured to generate all of the possible combinations of filtered microphone audio signals to then route these combinations such that they can be pairwise correlated as described herein.

In some embodiments the calibration system comprises a pairwise correlator 105. The pairwise correlator 105 receives the output of the bandpass filter and performs a pairwise correlation to determine the maximum correlation between all microphone pairs. The pairwise correlator or means for correlating can be considered to be determining from the at least part of the at least two microphone signals at least one audio source based on the at least one acoustic source.

The maximum correlation delay for each input/microphone pair ($m_{Xi,k}$ and $m_{Xi,l}$) can in some embodiments be determined based on the following expression $$\tau_{i,k,l} = \underset{\tau}{\operatorname{argmax}} \sum_{t=0}^{20\,ms} m_{Xi,k}(t) * m_{Xi,1}(t-\tau),$$

$$\tau \in [-\text{max_delay}(m_{Xi,k}, m_{Xi,l}), \text{max_delay}(m_{Xi,k}, m_{Xi,l})]$$

Where the maximum delay (max_delay) that is used in the search is the time sound takes to travel the distance (along the surface of the device) between the microphones in the pair.

The output of the pairwise correlator 105 can then be passed to the comparator 107.

The operation of pairwise correlating the filtered audio signals is shown in FIG. 3 by step 207.

In some embodiments the calibration system comprises a comparator 107. The comparator 107 is configured to receive the pairwise correlation outputs between all microphone pairs and compare these values against known time differences between the microphones for the subset. In other words comparator 107 can be configured to determine whether $$\Delta(Xi,k,l) \approx_{i,k,l}$$

where the known or determined time difference between microphones $m_{Xi,k}$ and $m_{Xi,l}$ in Subset i is Δ(Xi, k, l) for all pairs of k and l.

The directionality can be in single plane (for example defined with respect to a 'horizontal' or 'vertical' axis either with respect to the apparatus or with respect to true orientation) or can be in two planes (for example defined with respect to both a horizontal and vertical axis either with respect to the apparatus or with respect to true orientation).

Furthermore in some embodiments the similarity test can be determined by calculating the difference between the pre-determined or modelled time difference and the pairwise microphone audio signal determination and comparing the difference against a threshold value. However it would be understood that in some embodiments the values of Δ(Xi, k, l) define a range or lie within a defined range or sector and that the measured maximum correlation value is similar where the measured maximum correlation value is within the defined range or sector.

In other words the comparator 107 is configured to determine whether the audio signal comprises sound arriving from the direction which has been determined that correctly calibrated microphones produce equal level outputs (or a suitable audio signal from which to check or determine calibration).

In some embodiments the comparator 107 comprises or contains the determined subset time differences. However as described above in some embodiments the comparator can be configured to receive the centre frequency information via an input (and from a controller configured to control the comparator 107 such that the sub-set selection, frequency and direction determination are configured for the determined sub-sets).

The operation of comparing whether the delay is similar to the max correlation time is shown in FIG. 3 by step 209.

Where the comparator 107 determines that the pairwise correlation outputs between all microphone pairs are not similar to the known time differences between the microphones (in other words that there are no sounds within the audio signal sound coming from the sub-set direction) then the comparator (or a controller or controller means) can be configured to determine whether all of the sub-sets have been selected or searched for.

The operation of determining whether all of the sub-sets have been selected (or searched for) is shown in FIG. 3 by step 210.

Where all of the sub-sets have been selected (searched for) then the comparator or suitable controller or means for controlling can be configured to end calibration.

The operation of ending calibration is shown in FIG. 3 by step 212.

It would be understood that in some embodiments where calibration is constant (for example as some microphone impairment detection where the user can accidently cover up a microphone whilst using the apparatus) then the operation can pass back to the initial operation for receiving or determining audio signals (in other words step 201).

Where not all of the subsets have been selected or searched for then the comparator or suitable controller or means for controlling can be configured to select the next subset to check for using the current audio signals. In some embodiments this can be implemented by the comparator or suitable controller outputting the subset audio selections to the sub-set selector 101, centre frequency to the bandpass filter 103 (and the delay times to the comparator 107).

The operation of selecting the next subset values is shown in FIG. 3 by step 214.

Where the comparator 107, or suitable means for comparing, determines that the pairwise correlation outputs between all microphone pairs are similar to the known time differences between the microphones. In other words that there is within the audio source a direction which is similar to a known calibration friendly direction. In other words that the direction of the audio source is such that there should when the microphones are operating correctly be a known and defined relationship such as a known or defined signal level relationship or a known or defined signal phase relationship. When this condition is met then the comparator can be configured to indicate to the calibrator to perform a calibration operation. In some embodiments therefore the comparator 107 can be configured to output or control the output of the filtered sub-set audio signals to the calibrator.

Although in the embodiments described herein the audio signals from the microphones are filtered to determine at least one part of the at least two microphone signals which is then analysed to determine at least one audio source or component (the dominant signal part for that frequency band) using the expected sub-set centre frequencies as frequency band centre frequencies, it would be understood that in some embodiments the filters (or suitable means for filtering) can be considered to be a sub-set of the means for determining from at least part of the at least two microphone signals at least one audio source based on the at least one acoustic source. In other words a filter-bank used to generate a range of outputs from which an audio source direction can be determined and used as the basis of the calibration.

In some embodiments the calibration system comprises a calibrator 109 or suitable means for calibrating. The calibrator in some embodiments is configured to receive the output of the comparator 107 when the comparator 107 determines that within the recorded or input audio signals there is a sound with a frequency range and direction which is known to produce equal level outputs for a selected subset of the microphones/inputs. In other words in some embodiments the calibrator 109 is configured to receive the selected filtered audio signals when the subset determination is made by the comparator 107.

The calibrator in some embodiments determines and stores calibration information. In some embodiments the calibration information comprises level values for all the microphones (calibration=$[c_1, c_2, \ldots, c_N]$). On initialization of the apparatus the calibration values are 0 in other words $c_i=0$ for all i. In some embodiments the calibration information further comprises a variable $R=[R_1, R_2, \ldots, R_N]$ which logs or records the number of times a microphone calibration value has been updated. Over time when calibration measurements are made, these values are changed.

In some embodiments when the sound is detected to be coming from the right direction for a subset, calibration can be made to at least one of the microphone signals. In such embodiments calibration can be made to at least one of the microphone signals based on the determined direction of the determined audio source. For example the uncalibrated levels of the microphones or input bandpass filtered signals for microphones in Subset i is determined as:

$$\text{levels} = [l_{X_{i,1}}, l_{X_{i,2}} l_{X_{i,3}}, \ldots, l_{X_{i,N_i}}].$$

The average of the uncalibrated levels can be determined as $$ave_l = \frac{1}{N_i}\sum_{p=1}^{N_i} l_{X_{i,p}}$$

$$ave_m = \frac{1}{N_i}\sum_{p=1}^{N_i} m_{X_{i,p}}$$

The calibrator 109 thus determines an average over time of these values in the calibration variable. Each time a new set of levels values is determined to be available by the comparator 107 or suitable controlling means then the calibrator 109 can be configured to update the values in the calibration variable (corresponding to the microphones in the levels variable) as follows:

$$C_r \leftarrow \frac{R_r * c_r + \dfrac{m_r - l_r \dfrac{ave_m}{ave_l}}{m_r}}{R_r + 1},$$

$$r \in \{X_{i,1}, X_{i,2}, \ldots, X_{i,N_i}\}$$

where $R_r$ is the number of times $c_r$ has previously been updated.

In some embodiments the calibrator can be configured to add emphasis to later samples to the update rule.

In some embodiments the calibration values used for microphone signals are decibel domain values.

The operation of calibrating the microphone system using the filtered selected audio levels is shown in FIG. 3 by step 211.

Once the calibration operation is complete in some embodiments the calibration operation can pass back to the step of determining if all of the subsets have been selected/searched. In other words the operation can pass back to step 210 as shown in FIG. 3.

Figure 5:
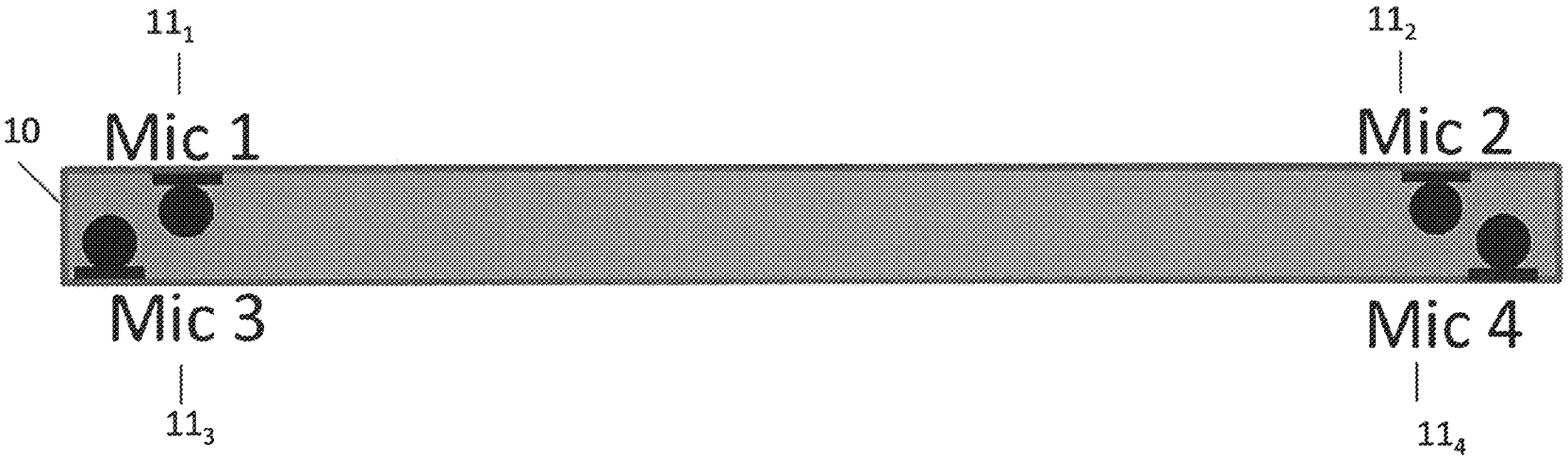
FIG. 5 shows schematically an example microphone system arrangement.

With respect to FIG. 5 an example apparatus is shown which would be suitable for performing the calibration operation as discussed herein and further discussed hereafter. In the example discussed above the subset information is determined only when the sound is determined to have the same level. However it would be understood that in some embodiments the subset information can be determined when directional sound reaches different microphones at known but different levels from some directions at determined frequencies. In such information the calibration component level can be used to define the known but different level as described herein.

Furthermore although in the following example the directional component is in the horizontal plane with a single degree of freedom (azimuth, it would be understood that in some embodiments the directionality of the audio signal is determined in elevation or a combination of azimuth or elevation to determine a two degree of freedom component.

FIG. 5 shows an example apparatus or device comprising 4 microphones (mic 1 $\mathbf{11}_1$, mic 2 $\mathbf{11}_2$, mic 3 $\mathbf{11}_3$ and mic 4 $\mathbf{11}_4$). The apparatus comprises mic 1 $\mathbf{11}_1$ and mic 2 $\mathbf{11}_2$ located substantially on opposite ends (mic 1 $\mathbf{11}_1$ on the left hand side and mic 2 $\mathbf{11}_2$ on the right hand side) and directed towards the camera side (a front side) of the apparatus or device and mic 3 $\mathbf{11}_3$ and mic 4 $\mathbf{11}_4$ located substantially on opposite ends (mic 3 $\mathbf{11}_3$ on the left hand side and mic 4 $\mathbf{11}_4$ on the right hand side) on the display side) or the rear of the device.

In the following example the microphones are configured to capture or record sounds which are output as audio signals to a bandpass filter. In this example the bandpass filter is configured to operate to pass the audio signals for three frequency bands F1=100 Hz-200 Hz, F2=200 Hz-400 Hz, and F3=400 Hz-1000 Hz.

Figure 6:
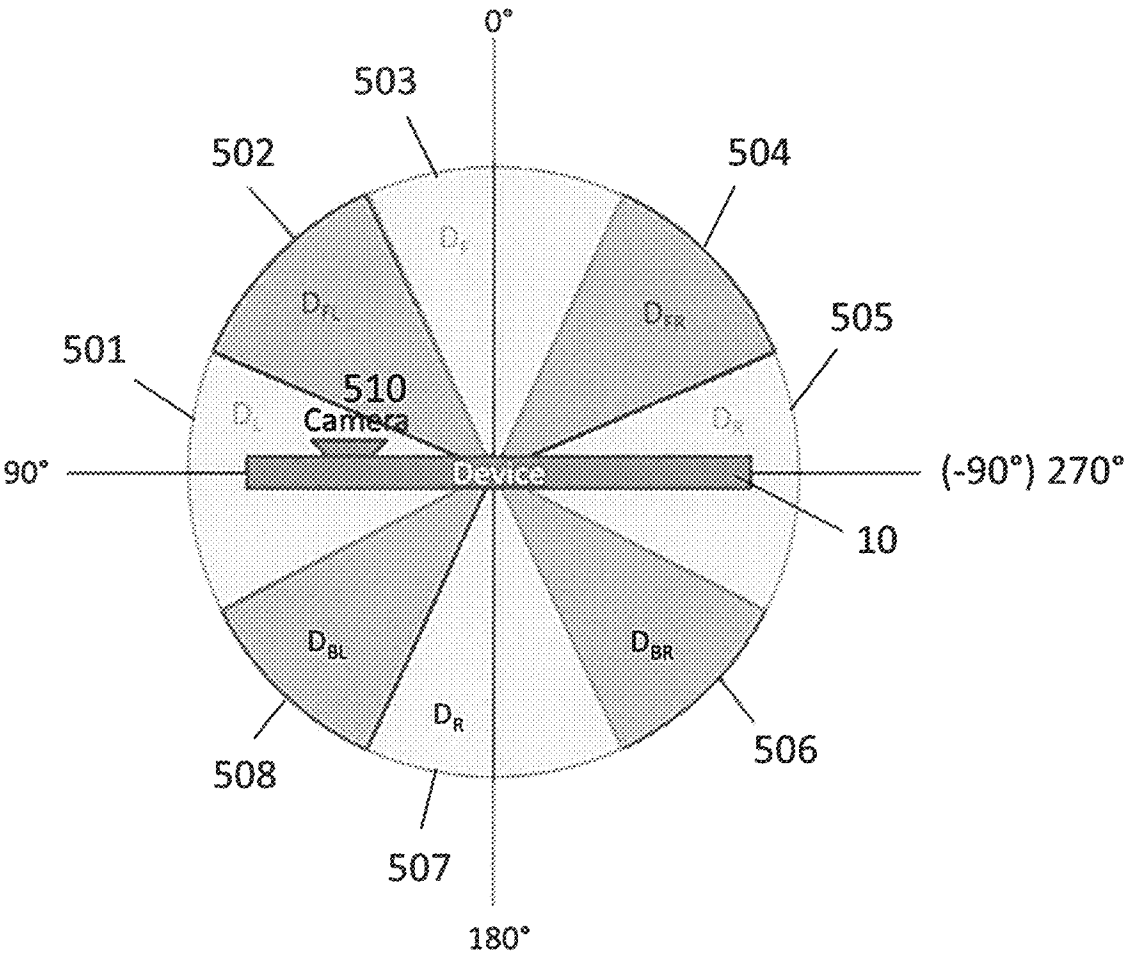
FIG. 6 shows schematically a directional sectorization of the area about the example microphone system shown in FIG. 5.

In these examples the apparatus is configured to video recording (with associated audio tracks). With respect to FIG. 6 the apparatus 10 is shown such that the direction a is on a horizontal plane so that 0° is directly to the front from the apparatus (in the camera 510 direction), 90° is left, 180° is back (towards the user from the device or in the display direction) and 270° is right. Furthermore FIG. 6 shows a division of the horizontal plane into sectors $D_F$ 503 which extends from −22.5° to +22.5°, $D_{FL}$ 502 which extends from +22.5° to +67.5°, DL 501 which extends from +67.5° to +112.5°, $D_{BL}$ 508 which extends from +112.5° to +157.5°, $D_B$ 507 which extends from +157.5° to +202.5°, $D_{FR}$ 504 which extends from −22.5° to −67.5°, DR 505 which extends from −67.5° to −112.5°, and $D_{BR}$ 506 which extends from −112.5° to −157.5°.

It would be understood that in some embodiments the sectorization of the space about the apparatus can be any suitable sectorization and can be regular as shown herein or irregular (with sectors having differing widths). Furthermore in some embodiments the sectors can at least partially overlap. It would be further understood that the number of sectors shown herein is an example of the number of sectors and as such in some embodiments there can be more than or fewer than 8 sectors.

In the following examples the apparatus has been tested or modeled to generate the prior information about the Subsets. For example:

Subset 1: [mic 1, mic 2], $\text{levels}_1$=[100, 100], $\epsilon D_F$ and $F\epsilon[F_1, F_2, F_3]$ In other words subset 1 is where directional sounds from the front should arrive equally loud at all frequencies to microphones 1 $\mathbf{11}_1$ and 2 $\mathbf{11}_2$.

Subset 2: [mic 1, mic 2, mic 3, mic 4], $\text{levels}_1$=[100, 100, 50, 50], $\epsilon D_F$ and $F\epsilon[F_1]$ In other words subset 2 is where directional sounds from the front should arrive half as loud at low frequencies to the display (back or rear) side microphones compared to camera (front) side microphones.

Subset 3: [mic 1, mic 2, mic 3, mic 4], $\text{levels}_1$=[100, 100, 25, 25], $\epsilon D_F$ and $F\epsilon[F_2]$ In other words subset 3 is where directional sounds from the front should arrive one-quarter as loud at middle frequencies to display side microphones compared to camera side microphones.

Figure 7:
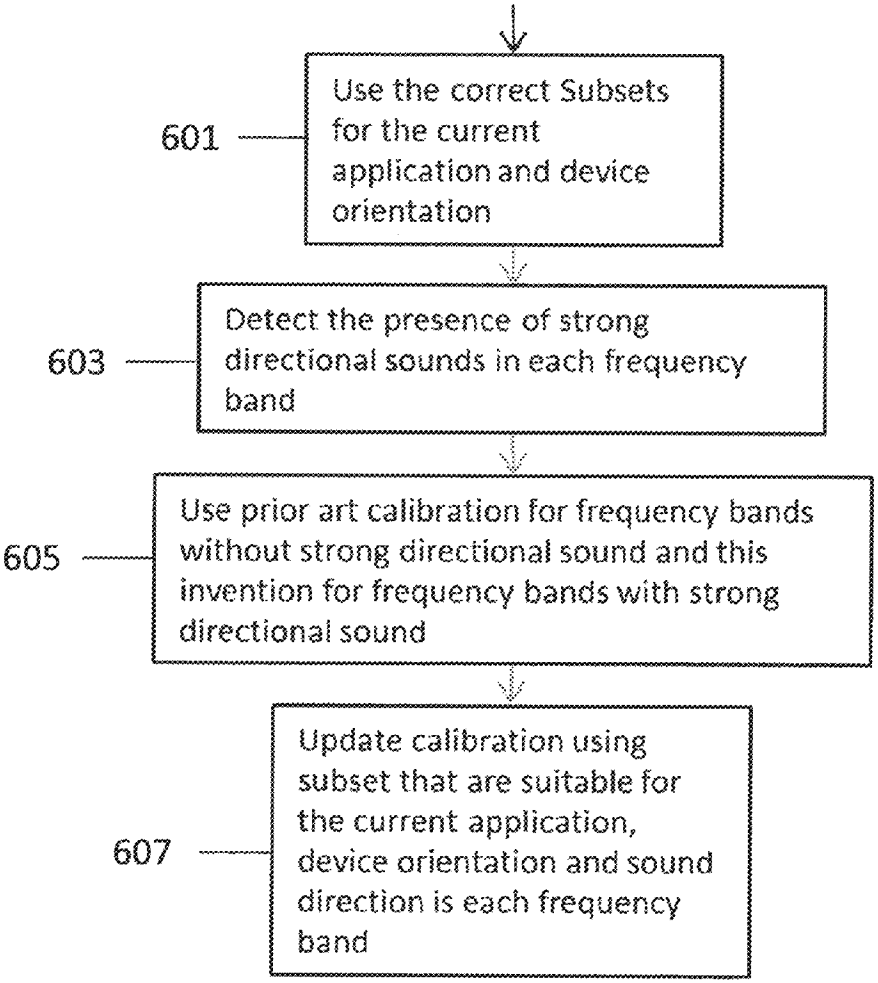
FIG. 7 shows a flow diagram of the operation of the calibration system within a non-directional calibration system.

With respect to FIG. 7 the operations of the example calibration system described herein are shown.

Thus for example the correct subsets for the current application and device orientation are selected.

The operation of using the correct subsets for the current application and device orientation is shown in FIG. 7 by step 601.

Furthermore the calibration system can in some embodiments be configured to receive the audio signals from the microphones and determine whether the audio signals comprise strong directional sounds, in other words whether the filtered selected audio signals generate a significant directional correlation value.

The operation of attempting to determine or search for the presence of a strong direction sound in each of the frequency bands is shown in FIG. 7 by step 603.

In those frequency bands where there is no strong directional sound present, then the calibration system can implement any suitable prior art microphone calibration method shown in FIG. 7 by step 605. In other words where the audio signal is non-directional then non directional calibration approaches can be implemented.

However where strong directional sounds are determined then the calibration implementations as described herein can be used as shown in FIG. 7 by step 605.

For example where the microphone calibration for each microphone is originally set to 1:

calibration=[c(mic1), c(mic2), c(mic3), c(mic4)]=[1, 1, 1, 1]

Furthermore a strongly directional sound in frequency band $F_2$ is determined to come from the front direction but in frequency bands $F_1$ and $F_3$ there are no strong directional sounds.

In this example the audio signals comprising the sounds coming from frontal direction cause the following example approximate time delays between all microphone pairs:

mic1, mic2: 0
mic1, mic3: 30 μs
mic1, mic4: 30 μs
mic2, mic3: 30 μs
mic2, mic4: 30 μs
mic3, mic4: 0

Therefore, if the following equations hold:

$$0 \approx \underset{\tau}{\operatorname{argmax}} \sum_{t=0}^{20ms} mic1_{F_2}(t) * mic2_{F_2}(t-\tau),$$

$$\tau \in [-500\ \mu s, 500\ \mu s]$$

$$30 \approx \underset{\tau}{\operatorname{argmax}} \sum_{t=0}^{20ms} mic1_{F_2}(t) * mic3_{F_2}(t-\tau),$$

$$\tau \in [-35\ \mu s, 35\ \mu s]$$

$$30 \approx \underset{\tau}{\operatorname{argmax}} \sum_{t=0}^{20ms} mic1_{F_2}(t) * mic4_{F_2}(t-\tau),$$

$$\tau \in [-535\ \mu s, 535\ \mu s]$$

$$30 \approx \underset{\tau}{\operatorname{argmax}} \sum_{t=0}^{20ms} mic2_{F_2}(t) * mic3_{F_2}(t-\tau),$$

$$\tau \in [-535\ \mu s, 535\ \mu s]$$

$$30 \approx \underset{\tau}{\operatorname{argmax}} \sum_{t=0}^{20ms} mic2_{F_2}(t) * mic4_{F_2}(t-\tau),$$

$$\tau \in [-35\ \mu s, 35\ \mu s]$$

$$0 \approx \underset{\tau}{\operatorname{argmax}} \sum_{t=0}^{20ms} mic3_{F_2}(t) * mic4_{F_2}(t-\tau),$$

$$\tau \in [-500\ \mu s, 500\ \mu s],$$

where mic $i_{F_2}$ is microphone i signal in frequency band $F_2$, where it has been determined that there is a strong directional sound in the front of the apparatus in frequency band $F_2$. It would be understood that the different limits for the search range (35 μs, 500 μs, 535 μs) are due to the different distances between the microphones.

Since there is a strong directional sound in frequency band $F_2$ from the front of the apparatus subsets 1 and 3 can be used to calibrate the microphones.

For example where the detected levels for the four microphones in frequency band $F_2$ are for Subset 1 are [190, 220] and for Subset 3 are [190, 220, 40, 55].

Then $$C_r \leftarrow \frac{R_r * c_r + \frac{m_r - l_r \frac{ave_m}{ave_l}}{m_r}}{R_r + 1},$$

$$r \in \{X_{i,1}, X_{i,2}, \ldots, X_{i,N_i}\}$$

becomes for Subset 1

$$[c(mic1), c(mic2)] \leftarrow \frac{[c(mic1), c(mic2)]R_1 + \frac{[100, 100] - [190, 220]\frac{ave[100, 100]}{ave[190, 220]}}{[100, 100]}}{R_1 + 1}$$

where $R_1$ is the number of times Subset 1 has been updated previously and all vector operations are done component wise. Similarly, the calibration values can be updated based on Subset 3.

$$[c(mic1), c(mic2), c(mic3), c(mic4)] \leftarrow \frac{[c(mic1), c(mic2), c(mic3), c(mic4)]R_3 + \frac{[100, 100, 25, 25] - [190, 220, 40, 55]\frac{ave[100, 100, 25, 25]}{ave[190, 220, 40, 55]}}{[100, 100, 25, 25]}}{R_3 + 1}$$

The operation of performing calibration using the subsets which are suitable for the directional sound is shown in FIG. 7 by step 607.

Figure 8:
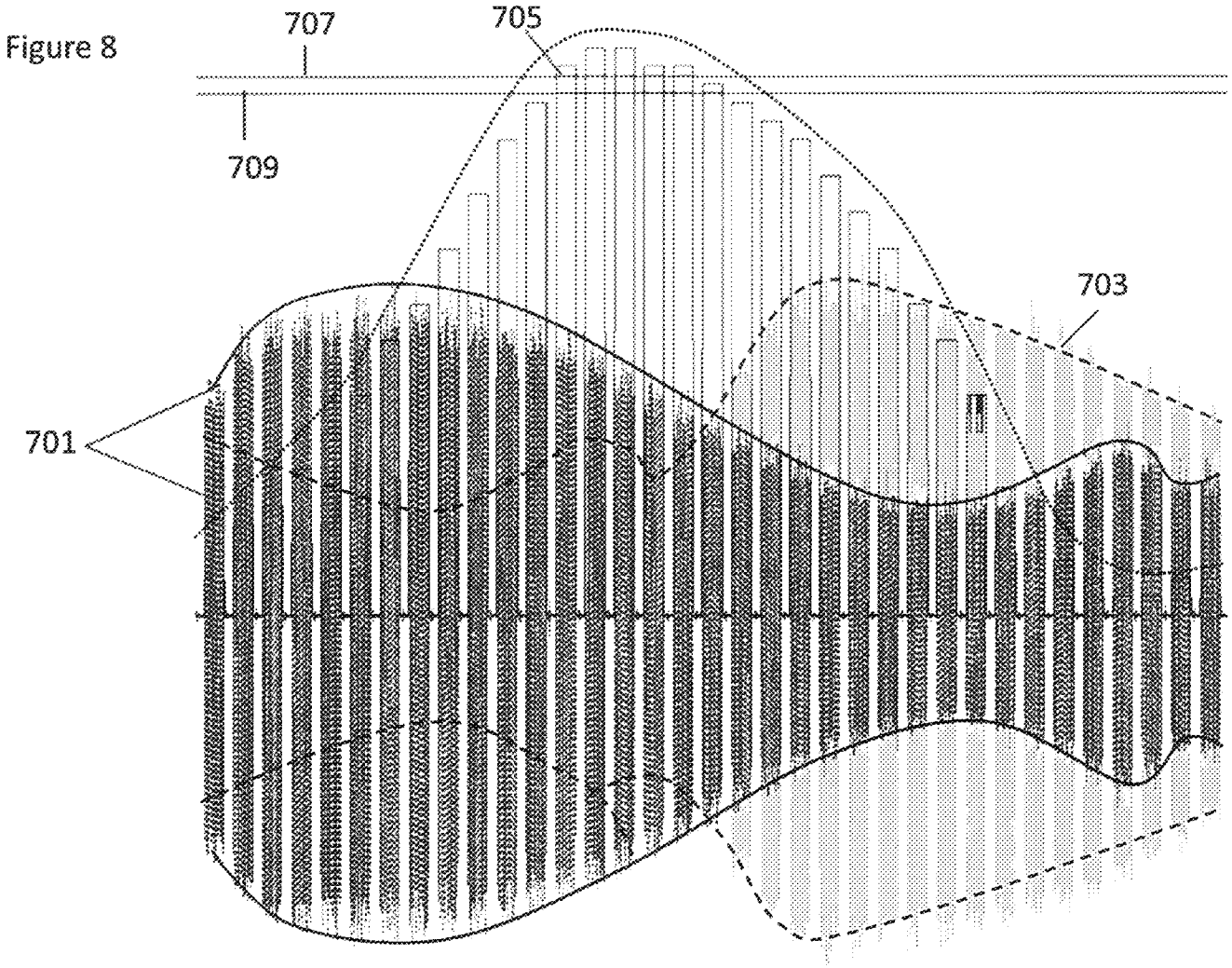
FIG. 8 shows schematically an example of a correlation between a pair of microphones within the calibration system.

FIG. 8 has real recorded microphone signals from a device. Noise bursts were played from different directions around the device. There were short periods of silence between the bursts. The apparatus used in this example comprises two microphones. The signal from microphone 1 shown by the solid line envelope 701 and the signal from microphone 2 is shown by the dashed line envelope 703. As can be seen the levels of the signals picked up by the microphones vary greatly as a function of the direction of the noise. The direction of the incoming noise was detected by calculating the delay that causes the maximum correlation between the two microphone signals as described herein. The maximum correlation inducing delay is depicted by the blocks and dotted line 705. The delay was calculated in 100 ms windows and it was set to zero when the microphone signals were too quiet. It can be seen the two microphone signals have approximately the same level only when the noise is coming from one particular direction. Noise coming from this direction causes the delay to fall between the two horizontal black lines 707 709. Thus the two microphone signals should only be calibrated when the delay that achieves maximum correlation between the two signals falls between the two black horizontal lines.

The operation of a microphone may be impaired when the input of a microphone is blocked, partially blocked, broken, partially broken and/or distorted by external environmental factors such as wind. In some cases the microphone can be impaired by a temporary impairment, for example a user's fingers when holding the apparatus in a defined way and over the microphone ports. In some other cases the microphone can be impaired in a permanent manner, for example dirt or foreign objects lodged in the microphone ports forming a permanent or semi-permanent blockage. In some embodiments the impairment detection can by operating over several instances handle both temporary and permanent impairment.

In the description herein the term impaired, blocked, partially blocked or shadowed microphone would be understood to mean an impaired, blocked, shadowed or partially blocked mechanical component associated with the microphone. For example a sound port or ports associated with the microphone or microphone module. The sound ports, for example, are conduits which are acoustically and mechanically coupled with the microphone or microphone module and typically integrated within the apparatus. In other words the sound port or ports can be partially or substantially shadowed or blocked rather than the microphones being directly blocked or shadowed. In other words the term microphone can be understood in the following description and claims to define or cover a microphone system with suitably integrated mechanical components, and suitably designed acoustic arrangements such as apertures, ports, cavities. As such the characteristics of a microphone output signal can change when any of the integration parameters are impaired or interfered with. Thus a blocking or shadowing of a microphone port can be considered to be effectively the same as a blocking or shadowing of the microphone.

The concept of embodiments described herein may include adjusting the processing of signals received from the microphones in such an audio system in order to compensate for the impairment of a microphone based on the calibration output.

For example on determining a calibration output which significantly differs from a previous calibration an anomaly can be determined.

Where it is determined that an anomaly has occurred then an action can be taken in response to the detected anomaly.

The action to be taken may include alerting a user to the detection of an impaired operation of a microphone and/or may include providing some compensation for the impairment in order to maintain the quality of the received audio.

In some embodiments alerting a user to a detected impairment in operation of a microphone may include providing an indication to the user that an impairment has been detected by for example showing a warning message on a display means of the device 10, playing a warning tone, showing a warning icon on the display means and/or vibrating the device. In other or additional embodiments, the alert to the user may take the form of informing a user of the detected impairment by contacting the user via electronic means for example by email and/or a short messaging service (SMS) requesting that the device 10 is brought in for a service. The contacting may include in some embodiments information relating to service points where the device may be serviced.

In some embodiments the display or suitable visual user interface output means can be configured to provide the indication that impairment has been detected or that one of the microphones is operating correctly.

For example the apparatus 10 in recording an event shown visually on the display can show a signal level meter for each microphone separately. When one of the microphones is impaired the functional microphone signal level meter indicator can output a visual indication of the impairment.

In some embodiments the determination of impairment can cause the apparatus to switch in a different or spare microphone. Thus for example an impaired right microphone indicator (where an indicator shows an empty indicator with no indication about the signal level) can be displayed and a switched in third (redundancy) microphone signal level meter indicator can also be shown that could replace the usage of the impaired or non-functional microphone.

In some embodiments the user interface can be configured to display only the functional microphones in such a redundancy switching.

In some embodiments the display can be configured to indicate that a non-default microphone is being used. In some embodiments there can be displayed more than two or three microphone signal level indicators. For example in some embodiments there can be displayed a surround sound capture signal level meter for each of the microphone channels. In some embodiments where one of the microphones is determined to be impaired or non-functional, the signals can be downmixed which can be represented on the display. For example a five channel signal level meter "downmixed" to a stereo signal level meter indicating the signal levels for the stereo track being recorded or captured simultaneously.

In some embodiments the indicator can be configured to modify the user's habits, such as the way the user is holding the apparatus. For example a user may hold the apparatus 10 and one or more of microphones may be blocked by the user's fingers. The calibration output can then determine this and in some embodiments be used to generate equalisation or signal processing parameters to acoustically tune the input audio signals to compensate for the blockage.

In some embodiments the apparatus can display the microphone operational parameter on the display. The apparatus can for example display information that the microphones are either functional by generating a '#' symbol (or graphical representation) representing that the microphones are functional and generating a '!' symbol (or graphical representation) representing that the microphones are blocked or in shadow due to the user's fingers. It would be understood that in some embodiments the location of the symbol or graphical representation can be in any suitable location. For example in some embodiment the symbol or graphical representation can be located on the display near to the microphone location. However in some embodiments the symbol or graphical representation can be located on the display at a location near to the microphone location but away from any possible 'touch' detected area—otherwise the displayed symbol or graphical representation may be blocked by the same object blocking the microphone.

In some embodiments the apparatus or any suitable display means can be configured to generate a graphical representation associated with the microphone operational parameter; and determine the location associated with the microphone on the display to display the graphical representation. For example the apparatus can be configured in some embodiments to generate a graphical representation associated with the microphone operational parameter which comprises at least one of: generating a graphical representation of a functioning microphone for a fully functional microphone, such as the '#' symbol, generating a graphical representation of a faulty microphone for a faulty microphone, such as an image of a microphone with a line though it, generating a graphical representation of a blocked microphone for a partially blocked microphone, such as the '!' symbol, and generating a graphical representation of a shadowed microphone for a shadowed microphone.

It would be understood that in some embodiments the displayed graphical representation or symbol can be used as a user interface input. For example where the display shows a partially blocked or faulty microphone the user can touch or hover touch the displayed graphical representation to send an indicator to the control unit to control the audio signal input from the microphone (in other words switch the microphone on or off, control the mixing of the audio signal, control the crossfading from the microphone etc.).

In some embodiments the indicator and therefore the displayed graphical representation or symbol can be based on the use rather than the physical microphones.

In some embodiments the information concerning broken/blocked microphone detection results could be analysed by the apparatus or transmitted to a server suitable for storing information on the failure modes of microphones.

For example the server can in such circumstances gather information on the failure modes in an effective accelerated lifetime test which would enable rapid re-development of future replacement apparatus or improved versions of the apparatus.

Furthermore such embodiments by incorporating system-level field failure data, the apparatus can be configured to determine that only certain failure modes (either component failure or temporary misuse) have any practical importance and in such embodiments the apparatus can avoid implementing a very complex detection algorithm.

It shall be appreciated that the apparatus 10 may be any device incorporating an audio recording system for example a type of wireless user equipment, such as mobile telephones, portable data processing devices or portable web browsers, as well as wearable devices.

In general, the various embodiments of the invention may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

The embodiments of this invention may be implemented by computer software executable by a data processor of the mobile device, such as in the processor entity, or by hardware, or by a combination of software and hardware. Further in this regard it should be noted that any blocks of the logic flow as in the Figures may represent program steps, or interconnected logic circuits, blocks and functions, or a combination of program steps and logic circuits, blocks and functions. The software may be stored on such physical media as memory chips, or memory blocks implemented within the processor, magnetic media such as hard disk or floppy disks, and optical media such as for example DVD and the data variants thereof, CD.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits and processors based on multi-core processor architecture, as non-limiting examples.

Embodiments of the inventions may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules. Once the design for a semiconductor circuit has been completed, the resultant design, in a standardized electronic format (e.g., Opus, GDSII, or the like) may be transmitted to a semiconductor fabrication facility or "fab" for fabrication.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

The invention claimed is:

1. A method comprising:

receiving at least two microphone signals from at least two microphones, the at least two microphone signals associated with at least one acoustic source, wherein the at least one acoustic source is from an environment surrounding the at least two microphones;

processing at least part of the at least two microphone signals to determine at least one audio source based on the at least one acoustic source;

determining at least one direction associated with the determined at least one audio source; and calibrating at least one of the at least two microphone signals based on the at least one direction and further based on a number of times that calibration of the at least two microphone signals has been performed.

2. The method as claimed in claim 1, wherein processing at least part of the at least two microphone signals to determine the at least one audio source based on the at least one acoustic source comprises filtering each of the at least two microphone signals to generate a respective at least two associated microphone signal parts.

3. The method as claimed in claim 1, wherein determining the at least one direction associated with the determined at least one audio source comprises:

determining a maximum correlation of a time difference between a pair of the at least part of the two microphone signals; and determining a direction based on the maximum correlation of the time difference.

4. The method as claimed in claim 3, wherein calibrating the at least one of the at least two microphone signals based on the at least one direction comprises determining a direction based on the maximum correlation of the time difference in least one determined calibration direction.

5. The method as claimed in claim 4, wherein determining the direction based on the maximum correlation of the time difference in the at least one determined calibration direction comprises determining that the direction based on the maximum correlation of the time difference is within at least one determined calibration direction sector.

6. The method as claimed in claim 1, further comprising defining at least one direction for which the at least part of the at least two microphone signals have an expected signal relationship, wherein the expected signal relationship is at least one of signal level relationship and signal phase relationship.

7. The method as claimed in claim 6, wherein the expected signal level relationship is at least one of:

equal signal levels of the at least part of the at least two microphone signals; and a predefined ratio between the at least part of the at least two microphone signals.

8. The method as claimed in claim 6, wherein calibrating at least one of the at least two microphone signals based on the at least one direction comprises calibrating the at least two microphone signals based on the signal levels of the at least part of the at least two microphone signals and the expected signal level relationship.

9. The method as claimed in claim 1, wherein calibrating at least one of the at least two microphone signals based on the at least one direction comprises determining or updating at least one calibration value associated with a respective microphone signal based on at least one of:

a number of times the operation of calibrating the at least one of at least two microphone signals had been performed;

a signal level associated with the at least part of the at least two microphone signals;

an expected signal level relationship between the at least part of the at least two microphone signals when the at least one audio source is associated with at least one determined direction;

a signal phase difference associated with the at least part of the at least two microphone signals; and an expected signal phase difference relationship between the at least part of the at least two microphone signals when the at least one audio source is associated with at least one determined direction.

10. The method as claimed in claim 1, wherein calibrating at least one of the at least two microphone signals based on the at least one direction further comprises calibrating the at least two microphone signals based on a number of times the calibration of the at least two microphone signals has been performed.

11. An apparatus comprising at least one processor and at least one memory including computer code for one or more programs, the at least one memory and the computer code configured to with the at least one processor cause the apparatus to:

receive at least two microphone signals from at least two microphones, the at least two microphone signals associated with at least one acoustic source, wherein the at least one acoustic source is from an environment surrounding the at least two microphones;

process at least part of the at least two microphone signals to determine at least one audio source based on the at least one acoustic source;

determine at least one direction associated with the determined at least one audio source; and calibrate at least one of the at least two microphone signals based on the at least one direction and further based on a number of times that calibration of the at least two microphone signals has been performed.

12. The apparatus as claimed in claim 11, wherein the determined at least one audio source based on the at least one acoustic source causes the apparatus to filter each of the at least two microphone signals to generate a respective at least two associated microphone signal parts.

13. The apparatus as claimed in claim 11, wherein to determine the at least one direction associated with the determined at least one audio source causes the apparatus to determine a maximum correlation time of a difference between a pair of the at least part of the two microphone signals and a direction based on the maximum correlation of the time difference.

14. The apparatus as claimed in claim 13, wherein to calibrate the at least one of the at least two microphone signals based on the at least one direction comprises determining a direction based on the maximum correlation of the time difference in at least one determined calibration direction.

15. The apparatus as claimed in claim 14, wherein determining the direction based on the maximum correlation of the time difference in the at least one determined calibration direction comprises determining that the direction based on the maximum correlation of the time difference is within at least one determined calibration direction sector.

16. The apparatus as claimed in claim 11, wherein the determined at least one direction further comprises the at least part of the at least two microphone signals having an expected signal relationship, wherein the expected signal relationship is at least one of signal level relationship and signal phase relationship.

17. The apparatus as claimed in claim 16, wherein the expected signal level relationship is at least one of equal signal levels of the at least part of the at least two microphone signals and a predefined ratio between the at least part of the at least two microphone signals.

18. The apparatus as claimed in claim 16, wherein the apparatus is further caused to calibrate the at least two microphone signals based on the signal levels of at least part of the at least two microphone signals and the expected signal level relationship.

19. The apparatus as claimed in claim 11, wherein the calibrated at least one of the at least two microphone signals further causes the apparatus to update at least one calibration value associated with a respective microphone signal based on at least one of:

a number of times the operation of calibrating the at least one of at least two microphone signals had been performed;

a signal level associated with the at least part of the at least two microphone signals;

an expected signal level relationship between the at least part of the at least two microphone signals when the at least one audio source is associated with at least one determined direction;

a signal phase difference associated with the at least part of the at least two microphone signals; and an expected signal phase difference relationship between the at least part of the at least two microphone signals when the at least one audio source is associated with at least one determined direction.

20. A computer program product comprising a non-transitory computer readable storage medium, the non-transitory computer readable storage medium comprising program code, when executed by a processor, to configure the processor to:

receive at least two microphone signals from at least two microphones, the at least two microphone signals associated with at least one acoustic source, wherein the at least one acoustic source is from an environment surrounding the at least two microphones;

process at least part of the at least two microphone signals to determine at least one audio source based on the at least one acoustic source;

determine at least one direction associated with the determined at least one audio source; and calibrate at least one of the at least two microphone signals based on the at least one direction and further based on a number of times that calibration of the at least two microphone signals has been performed.

* * * * *